US005114025A

United States Patent [19]

Verreet

[11] Patent Number: 5,114,025

[45] Date of Patent: May 19, 1992

[54] SWIVEL FOR USE IN CRANES AND THE LIKE

[75] Inventor: Roland Verreet, Aachen, Fed. Rep. of Germany

[73] Assignee: Drahtseilwerk Saar GmbH, Limbach, Fed. Rep. of Germany

[21] Appl. No.: 613,106

[22] Filed: Nov. 8, 1990

[30] Foreign Application Priority Data

Nov. 11, 1989 [DE] Fed. Rep. of Germany ..... 3937631

[51] Int. Cl.[5] ..... B66C 13/06

[52] U.S. Cl. ..... 212/147; 294/82.15

[58] Field of Search ..... 294/81.4, 82.11, 82.15; 212/148, 212, 147

[56] References Cited

U.S. PATENT DOCUMENTS

| | | | |
|---|---|---|---|
| 2,823,944 | 2/1958 | Anderson et al. | 294/82.15 |
| 3,009,728 | 11/1961 | Breslav | 294/82.15 |
| 3,210,114 | 10/1965 | Lawton | 294/81.4 |
| 3,842,986 | 10/1974 | Hupkes | 294/81.4 |
| 4,286,722 | 9/1981 | Tax et al. | 294/81.4 |

FOREIGN PATENT DOCUMENTS

| | | | |
|---|---|---|---|
| 1444276 | 12/1988 | U.S.S.R. | 294/82.15 |

*Primary Examiner*—Sherman D. Basinger
*Assistant Examiner*—Thomas J. Brahan
*Attorney, Agent, or Firm*—Peter K. Kontler

[57] ABSTRACT

A swivel for use in a crane has a stationary upper member which is secured to the boom and a lower member which is rotatable relative to the upper member and is connected with the end of the cable. The cable is looped beneath the swivel and the bight of its loop carries a roll which supports the load. A driving unit is provided to positively rotate the lower member of the swivel when the cable portions flanking the roll beneath the swivel tend to cross each other. The driving unit is of the self-locking type or the lower member of the swivel can be braked to prevent a change in its angular position independently of the driving unit. If such independent change of angular position of the lower member is desired, the machine employs a load-responsive clutch which disengages the lower member from the driving unit in the absence of load upon the roll.

8 Claims, 2 Drawing Sheets

SWIVEL FOR USE IN CRANES AND THE LIKE

BACKGROUND OF THE INVENTION

The invention relates to cranes and like load raising, lowering and transferring machines, and more particularly to improvements in swivels for use in cranes or the like. Still more particularly, the invention relates to improvements in swivels which can be used in cranes and analogous machines to permit untangling of load-carrying flexible elements in the form of bands, cords, wires, cables or ropes (hereinafter called cables).

As used in the field of cranes, derricks, elevators, hoists, winches and like machines, the term swivel denotes a combination of two members one of which is acted upon by pull and can turn relative to the other member about an axis which coincides with the direction of pull. If the swivel is used in a crane, the other member is fixedly or articulately connected to the frame of the crane (e.g., to the boom) and one end of the cable is connected with the one member. The one end of the cable applies a load to the one member, and such one end of the cable can turn with the one member relative to the other member, for example, in order to relieve the cable of torsional or twisting stresses.

The cable of a crane is likely to be subjected to torsional stresses by the cable drum in normal use of the crane, particularly by a cable drum which is designed to store several layers of convoluted cable. For example, torsional stresses will develop if the idler rollers are not accurately aligned with the cable. This entails a twisting of the cable and the development of undesirable torsional stresses. If the cable which is connected with the one member of the swivel is looped, and the bight of its loop carriers a dancer roll for a crane hook or another load carrying structure, twisting is likely to take place in that part of the cable which extends from the dancer roll toward the cable drum. Thus, even though that portion of the cable which extends between the dancer roll and the one member of the swivel is less likely to be twisted, torsional stresses acting upon the other portion of the cable (between the dancer roll and the cable drum) are often sufficiently pronounced to cause a change of orientation of the dancer roll and a crossing of cable portions which flank the dancer roll. Such crossing is particularly likely to take place if the cable is long, i.e., if the load carrying structure on the dancer roll is called upon to raise or lower a load through a considerable distance. Crossing of cable portions which flank the load carrying parts is undesirable because the two portions of the cable rub against each other and the load is likely to turn during raising or lowering.

OBJECTS OF THE INVENTION

An object of the invention is to provide a novel and improved swivel which can reliably prevent crossing of cable portions at opposite sides of the load carrying part or parts in a crane or a like machine.

Another object of the invention is to provide a swivel which can be installed in existing cranes or like machines as a superior substitute for heretofore used swivels.

A further object of the invention is to provide novel and improved stationary and rotary members for use in the above outlined swivel.

An additional object of the invention is to prevent the likelihood of development of pronounced torsional stresses in the cable of a crane or a like machine.

Still another object of the invention is to provide a crane or a like machine which embodies the above outlined swivel.

A further object of the invention is to provide a method of preventing the development of any, or the development of pronounced, torsional stresses in the cable of a crane or a like load raising, lowering and transferring machine.

SUMMARY OF THE INVENTION

The invention is embodied in a swivel for one end of a looped cable having a bight for a load-supporting device, e.g., a dancer roll which is used in a crane. The improved swivel comprises a normally stationary first member, a second member which is rotatably mounted on the first member and is connectable with one end of a cable, and means for rotating the second member relative to the first member, normally about a substantially vertical axis. The second member can include an upper portion which is adjacent the first member and a lower portion which is connectable with one end of a cable.

The rotating means can comprise a self-locking driving unit. Alternatively or in addition to such self-locking feature, the swivel can comprise means for braking the second member.

The swivel can further comprise means for disconnecting the rotating means from the second member to permit rotation of the second member relative to the first member independently of the rotating means. For example, the disconnecting means can comprise a load-responsive clutch which connects the second member to the rotating means in response to the application of load to the second member (such as by way of the cable and the dancer roll) and is disengaged in the absence of load upon the second member.

A frame (such as the frame of a crane) can be provided to carry the first member. One of the two members is or can be disposed at a level above the other member; for example, the first member can be disposed at a level above the second member.

The rotating means is or can be installed in the first member.

The novel features which are considered as characteristic of the invention are set forth in particular in the appended claims. The improved swivel itself, however, both as to its construction and the mode of installing and using the same, together with additional features and advantages thereof, will be best understood upon perusal of the following detailed description of certain presently preferred specific embodiments with reference to the accompanying drawing.

DETAILED DESCRIPTION

Figure 1:
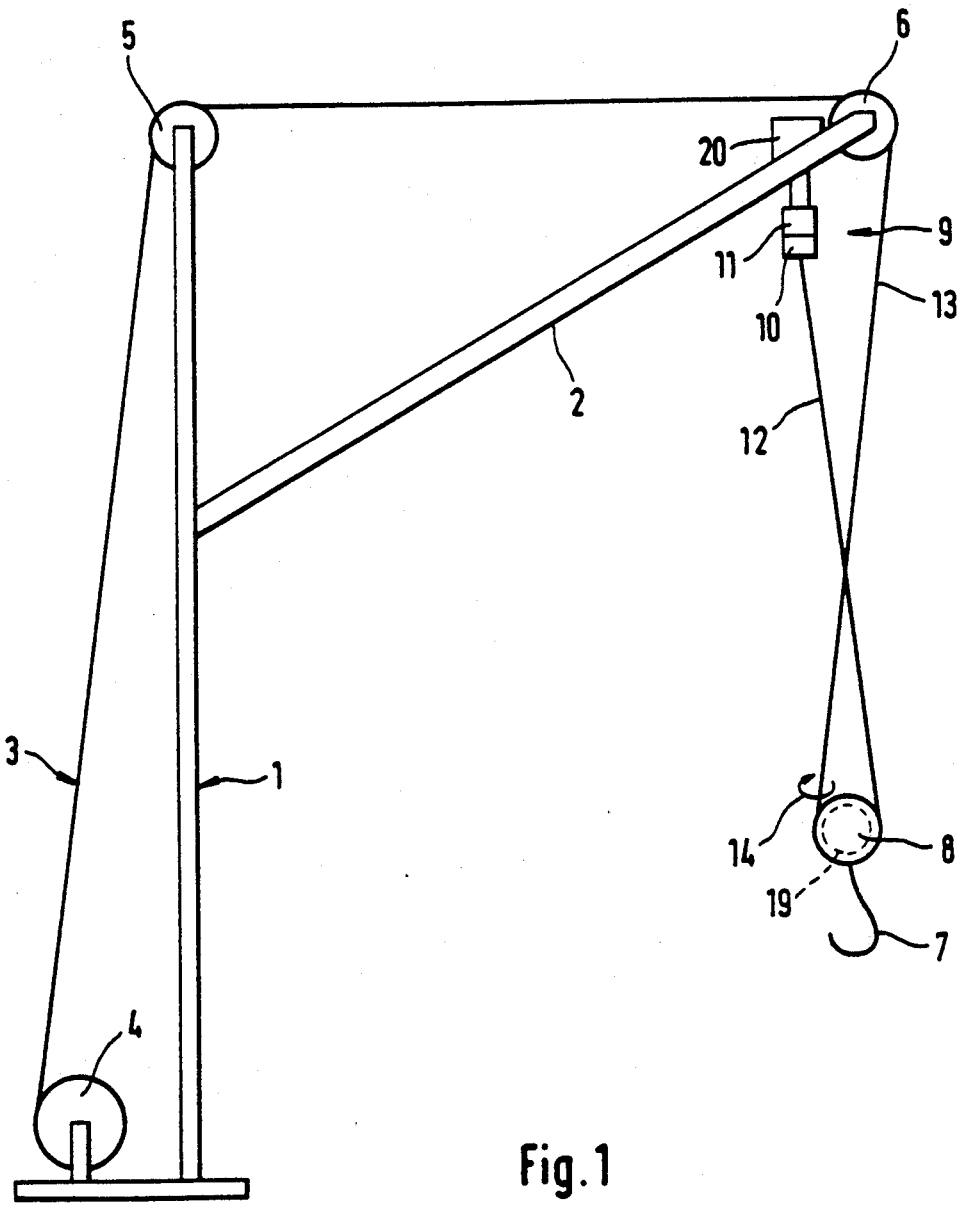
FIG. 1 is a schematic elevational view of a crane which is equipped with a swivel embodying one form of the present invention.

FIG. 1 shows a crane 1 having an upright frame with an elongated boom 2. The free end of the boom 2 carries an idler roller 6 for an elongated cable 3 which extends from a cable drum 4, over a second idler roller 5 and forms a loop around a dancer roll or sheave 8 provided with a load carrying crane hook 7. The dancer roll 8 is located in the bight of the loop which is defined by two cable portions or lengths 12 and 13. The cable portions 12, 13 flank the roll 8, the cable portion 13 forms part of the major portion of the cable 3 and extends between the dancer roll 8 and the idler roller 6, and the cable portion 12 has a free end which is connected to the rotary second or lower member 10 of a swivel 9. The latter further comprises a stationary (i.e., non-rotatable) first or upper member 11 which is articulately or rigidly connected to the boom 2 (i.e., to the frame of the crane 1) at a locus slightly beneath the idler roller 6. The swivel 9 can be said to constitute a means for turnable connecting the free end of the cable portion 12 to the boom 2.

Figure 1A:
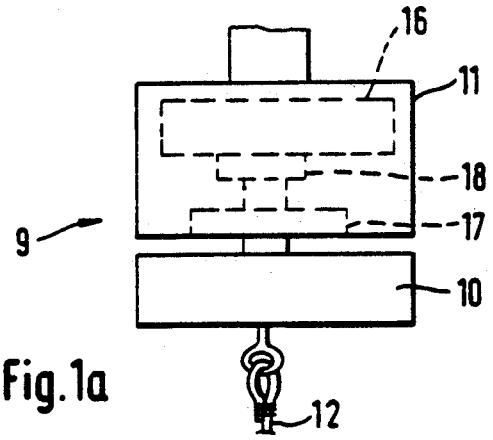
FIG. 1*a* is an enlarged view of the swivel and of the means for rotating and braking the rotary member of the swivel.

As can be seen in FIG. 1*a*, the stationary member 11 of the swivel 9 includes or constitutes a hollow housing which confines a self-locking driving unit 16 constituting a means for rotating the member 10 about an axis (this axis is substantially vertical in the machine of FIG. 1) which coincides with the direction of application of load from the hook 7, through the medium of the dancer roll 8 and by way of the cable portion 12. In addition to the self-locking feature, the driving unit 16 can be combined with or can embody a brake 17 which prevents unintentional rotation of the lower member 10 relative to the upper member 11 of the swivel 9.

FIG. 1 shows that only the cable portion 13 tends to turn the lower member 10 of the swivel 9 in the direction of arrow 14. Such tendency of the cable portion 13 to turn the member 10 entails a crossing of the cable portions 12, 13 at a level above the dancer roll 8. This can result in damage to and/or unnecessary and extensive wear upon the cable portions 12, 13 during raising or lowering of a load which is carried by the crane hook 7.

Figure 2:
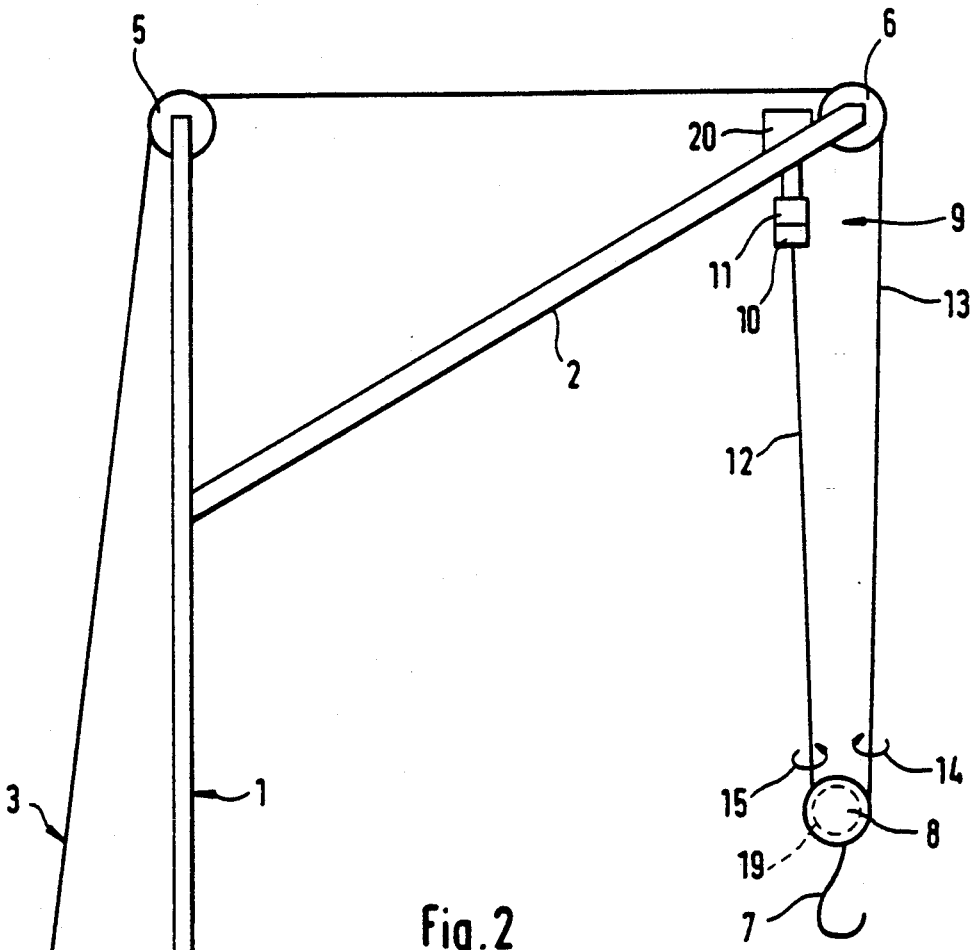
FIG. 2 is a view similar to that of FIG. 1 but showing the load-carrying structure subsequent to angular adjustment of the rotary member of the swivel.

FIG. 2 shows the structure of FIG. 1 but subsequent to intentional rotation of the lower member 10 of the swivel 9 by the driving unit 16 in the direction of arrow 15. This counteracts the tendency of the cable portion 13 to twist in the direction of arrow 14, and the cable portions 12, 13 remain out of contact with each other. The torque which is applied to the cable portion 12 by the member 10 at least substantially neutralizes the torque which the cable portion 13 tends to apply in order to bring about the condition which is shown in FIG. 1, i.e., a crossing of cable portions 12, 13 between the dancer roll 8 and the swivel 9.

It will be seen that, by the expedient of providing a driving unit 16 which can positively turn the lower member 10 of the swivel 9 relative to the upper member 11, the forces which tend to bring about a crossing of the cable portions 12, 13 can be counteracted in a simple and reliable way. The driving unit 16 can be started in a desired direction from a control panel (not specifically shown) of the crane 1. The exact details of such driving unit form no part of the invention; for example, the driving unit can include a stepping motor which can turn the member 10 in a clockwise or in counterclockwise direction through increments of desired magnitude. The operator of the crane 1 can readily detect the need for operation of the driving unit 16, i.e., this unit will be activated to change the orientation of the dancer roll 8 when the operator notes that the orientation of the dancer roll departs from that which is shown in FIG. 2 and in which the cable portions 12, 13 are spaced apart from each other.

When the crane 1 is in actual use, initial correction of orientation of the dancer roll 8 can be followed by minor additional corrections. When the crane 1 is in actual use to raise or lower a load which is suspended on the crane hook 7, the length of the cable portion 12 increases during lowering of the load and decreases during lifting of the load. This might necessitate some additional rotation of the member 10 in a clockwise or counterclockwise direction. The member 10 can be positively turned by the driving unit 16 to compensate for torsional stresses in the cable portion 13 as well as in the cable portion between the idler roller 6 and the cable drum 4.

The mode of operation of the improved swivel 9 is not much different if the swivel is installed in a multiple-cable block and tackle with several dancer rolls. The swivel is then designed to apply torque to the last cable while a load is being raised or lowered, and the effect of such positive twisting of the last cable is felt all the way to the last cable and to the cable drum. Thus, torsional stresses which tend to change the orientation of the dancer rolls and to initiate a crossing of cable portions can be counteracted in the same way as described in connection with FIGS. 1 and 2. It is merely necessary to effect some additional adjustments (following initial adjustment of orientation of the load-carrying structure) while the block and tackle is in actual use.

It is often desirable or necessary to slightly overcompensate for the tendency of the cable portion 13 to change the orientation of the dancer roll 8. However, this is up to the experienced operator of the machine who can readily select the extend of turning the member 10 by the driving unit 16 so that the cable portion 13 is incapable of causing a crossing with the cable portion 12 between the load-carrying structure 7, 8 and the swivel 9.

The improved swivel 9 can be put to use under the aforediscussed circumstances, i.e., when the cable portion 13 tends to change the orientation of the dancer roll 8 to the extent as shown in FIG. 1. However, such swivel can be used with equal or similar advantage under certain other circumstances, e.g., when the cable tends to develop a so-called corkscrew effect at the fixed point. It has been found that, in either event, the improved swivel with a driving unit for the rotary member 10 can prolong the useful life of the cable to a considerable extent.

The provision of a self-locking feature and/or of the brake 17 is desirable and advantageous because this prevents the cable 3 from changing that orientation of the load-carrying structure which was selected by the driving unit 16.

It is often desirable and advantageous to use a swivel which permits the member 10 to freely turn relative to the member 11. For example, such ability of the member 10 to turn relative to the member 11 while the driving unit 16 is idle is desirable in order to permit relaxation of the cable 3. This can be achieved by utilizing a load-responsive clutch or an analogous disconnecting device 18 which is designed to connect the member 10 to the driving unit 16 in response to the application of a load to the cable hook 7 and dancer roll 8 but automatically disengages or disconnects the member 10 from the unit 16 when the dancer roll 8 is not acted upon by a load or when the magnitude of such load is below a threshold value. For example, the clutch 18 will disengage the driving unit 16 from the member 10 before the crane 1 is put to use. This ensures that an operator who was not away of the magnitude of torsional stresses upon the cable portion 12 knows that the magnitude of torsional stresses is zero at the start of operation because the disengaged clutch 18 enables the member 10 to turn in a direction to reduce or eliminate the stresses upon the cable portion 12 and/or 13. Moreover, the operator might wish to intentionally disengage the clutch 18 when the nature of work to be performed by the crane 1 is such that pronounced (or any) twisting of the cable portion 12 and/or 13 is not likely.

It is further within the purview of the invention to provide automatic controls for the driving unit 16. For example, the dancer roll 8 or the crane hook 7 can carry an orientation monitoring device 19 which is operatively connected (preferably without relying on conductors and/or conduits) to the driving unit 16 in order to initiate a change of angular position of the member 10 when the orientation of the dancer roll 8 departs from a desired orientation. The control for the driving unit 16 can be mounted on top of the boom 2 (such controls are indicated by the box 20).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A swivel for one end of one of two portions of a single looped crane cable wherein the two portions define a bight for a load-supporting device including a sheave, comprising a first member non-rotatably connectable to a boom of a crane; a second member rotatably connected to said first member and non-rotatably connectable directly with the one end of the one portion of a crane cable; and means for rotating said second member relative to said first member to thereby oppose (a) a change of orientation of the sheave int he bight of the two portions of a crane cable and (b) actual contact between the two portions of such cable intermediate the sheave and the second member while the one end of the one portion is connected to said second member.

2. The swivel of claim 1, wherein said second member is rotatable about a substantially vertical axis and includes an upper portion adjacent said first member and a lower portion connectable with the one end of the one portion of a crane cable when said first member is connected to a boom.

3. The swivel of claim 1, wherein said rotating means comprises a self-locking driving unit.

4. The swivel of claim 1, further comprising means for braking said second member.

5. The swivel of claim 1, further comprising means for disconnecting said rotating means from said second member to permit rotation of said second member relative to said first member independently of said rotating means.

6. The swivel of claim 1, wherein said disconnecting means comprises a load-responsive clutch which connects said second member to said rotating means in response to the application of load to said second member and is disengaged in the absence of load upon said second member.

7. The swivel of claim 1, wherein one of said members is disposed at a level above the other of said members when said first member is connected to a boom.

8. The swivel of claim 1, wherein said rotating means is installed in said first member.

* * * * *